US006322152B2

(12) United States Patent
Trojanowski et al.

(10) Patent No.: US 6,322,152 B2
(45) Date of Patent: Nov. 27, 2001

(54) METHOD OF MAKING A TOOTHBRUSH

(75) Inventors: Alan G. Trojanowski, Monmouth Junction; Ruby E. Kirkup, Lawrenceville; Richard M. Prospero, Princeton, all of NJ (US)

(73) Assignee: McNeil-PPC, Inc., Skillman, NJ (US)

( * ) Notice: Subject to any disclaimer, the term of this patent is extended or adjusted under 35 U.S.C. 154(b) by 0 days.

(21) Appl. No.: 09/863,774

(22) Filed: May 23, 2001

Related U.S. Application Data

(62) Division of application No. 09/345,094, filed on Jun. 30, 1999, which is a continuation of application No. 08/995,666, filed on Dec. 22, 1997, now abandoned.

(51) Int. Cl.[7] ..... A46D 1/05; A46B 9/04

(52) U.S. Cl. ..... 300/21; 15/167.1; 15/DIG. 5

(58) Field of Search ..... 15/167.1, 207.2, 15/DIG. 5, DIG. 6; 300/21

(56) References Cited

U.S. PATENT DOCUMENTS

| | | | | |
|---|---|---|---|---|
| 2,066,068 | * | 12/1936 | Cooke | 15/167.1 |
| 2,429,740 | * | 10/1947 | Aufsesser | 15/167.1 |
| 2,554,777 | * | 5/1951 | Dangin | 15/207.2 X |
| 3,295,156 | * | 1/1967 | Brant | 15/167.1 |
| 5,165,761 | * | 11/1992 | Dirksing | 300/21 |
| 5,176,427 | * | 1/1993 | Weihrauch | 300/21 X |
| 5,593,213 | * | 1/1997 | Meessmann | 300/21 |
| 5,690,394 | * | 11/1997 | Boucherie | 300/21 X |

FOREIGN PATENT DOCUMENTS

| | | | | |
|---|---|---|---|---|
| 3433763 | * | 2/1986 | (DE) | 15/167.1 |
| 639340 | * | 2/1995 | (EP) . | |
| 98/38889 | * | 9/1998 | (WO) . | |

OTHER PUBLICATIONS

DuPont Filaments, "Tynex Shapes & Textures Toothbrush Filaments", pp. 1–22, Washington, WV, 1996.*

DuPont Company, "Tynex Innovations for Success", 1996.*

* cited by examiner

*Primary Examiner*—Mark Spisich

(57) ABSTRACT

The invention relates to a toothbrush that provides good subgingival access while being gentle and non-irritating to the oral soft tissue. The toothbrush of the invention comprises a brush head and a handle. The brush head comprises tufts of bristles generally parallel to each other and arranged in rows. The rows of bristles comprise outer rows adjacent the periphery of the brush head and at least one inner row between the outer rows. The inner bristles are preferably polished on their free ends and the outer bristles are feathered. The outer bristles are preferably polished prior to being feathered. The inner bristles are preferably shorter than the outer bristles.

44 Claims, 8 Drawing Sheets

METHOD OF MAKING A TOOTHBRUSH

This is a division of Ser. No. 09/345,094, filed Jun. 30, 1999, which is a continuation of Ser. No. 08/995,666, filed Dec. 22, 1997, abandoned.

FIELD OF THE INVENTION

This invention relates to a toothbrush and a method of making the same. More particularly, the invention relates to a toothbrush that has improved subgingival access and is gentle to the gums.

BACKGROUND OF THE INVENTION

Regular brushing of the teeth with a toothbrush is the primary oral care regimen leading to sustained good health in the oral cavity. It is well known that bacteria that collect in tartar and plaque at the tooth surfaces leads to the production of dental caries or cavities. Regular brushing reduces the incidence of caries by sweeping away plaque, thereby reducing sites of bacterial growth on the teeth.

Conventional toothbrushes do a poor job of removing plaque at or below the gum line. It is well known that one of the primary sites for caries formation is at that portion of the tooth behind the gingival sulcus, i.e., the pocket or groove formed from the apparent gum line to the point where the gums or gingiva attach to the teeth. Accordingly, it would be expected that a toothbrush that permits subgingival access, i.e., access to regions below the gum line, would be expected to be especially effective at reducing subgingival caries. Unfortunately, it has been heretofore difficult to achieve a toothbrush that provides good subgingival access while being gentle to the gums and to the other soft tissue in the oral cavity.

It is an object of the invention to provide a toothbrush that provides good subgingival access to aid in reducing the incidence of cavities near or behind the gum line.

It is another object of the invention to provide a toothbrush that is gentle to the gums and the soft tissue in the oral cavity.

It is another object of the invention to provide a toothbrush that provides good subgingival access while being gentle to the oral soft tissue.

It is yet another object of the invention to provide a process for making the toothbrushes of the invention.

BRIEF DESCRIPTION OF THE INVENTION

The present invention relates in a preferred mode to a toothbrush comprising a brush head and a handle. The brush head comprises a plurality of tufts, each tuft having a plurality of bristles. Each tuft has a first end secured to the brush head and a second free end. The tufts of bristles are arranged in rows aligned generally parallel to the longitudinal axis of the brush head, but may be oriented at an angle of up to about 30 degrees relative to the longitudinal axis of the brush head. The rows of bristles comprise outer rows adjacent the periphery of the brush head and at least one inner row between the outer rows. The bristles of the tufts of the at least one inner row are preferably polished on their free end and the bristles of the tufts of the outer rows are feathered.

In a more preferred embodiment, the bristles of the tufts of the at least one inner row are shorter than the bristles of the tufts of the outer rows. The bristles of the tufts of the at least one inner row are preferably about 1.0 to about 4.0 mm shorter than the bristles of the tufts of the outer rows. More preferably, the bristles of the tufts of the at least one inner row are about 2.0 to about 3.0 mm shorter than the bristles of the tufts of the outer rows. Most preferably, the bristles of the tufts of the at least one inner row are about 2.2 to about 2.8 mm shorter than the bristles of the tufts of the outer rows.

The bristles of the tufts of the outer rows are preferably hollow, having from about 2 to about 6 parallel channels per bristle, and more preferably, about 4 channels per bristle. The bristles of the tufts of the at least one inner row are preferably solid.

When the bristles of the tufts of the outer rows are longer than the bristles of the tufts of the at least one inner row, the free ends of the bristles of the tufts of the outer rows are feathered, as explained hereinafter, to a depth preferably no deeper than the free ends of the bristles of the tufts of the at least one inner row. The bristles of the tufts of the outer rows are preferably feathered to a depth of between about 0.5 mm to about 2.5 mm, and more preferably, to a depth of about 1.0 mm to about 2.0 mm.

Another aspect of the present invention is the process of making the toothbrush of the present invention, which comprises the steps of:

a) trimming the bristles of the tufts of at least the outer rows of bristles to provide a first desired topography;
b) displacing the tufts of the outer rows from the tufts of the at least one inner row to permit processing of the bristles of the tufts in the at least one inner row without affecting the bristles of the tufts of the outer rows;
c) trimming the bristles of the tufts of the at least one inner row to a second desired topography;
d) polishing the free ends of the bristles of the tufts of the at least one inner row;
e) returning the tufts of the outer rows to their original orientation; and
f) feathering the bristles of the tufts of at least the outer rows.

The process of the present invention may further comprise additional steps such as polishing the free ends of the bristles of the tufts of the outer rows prior to feathering the bristles of the tufts of the outer rows, and removing debris from the brush head, as, for example, by mechanically polishing the bristles and/or by directing compressed air and/or applying vacuum to the brush head.

The step of displacing the tufts of the outer rows from the tufts of the at least one inner row is preferably accomplished with a cam-driven spreading mechanism.

In one aspect of the process of the present invention, step (a) is only effected on the outer rows of tufts of bristles and is effected after step (e).

The heights to which the bristles are trimmed and feathered correspond to the relative dimensions of the preferred toothbrush of the invention as described above.

In a preferred process, the bristles of the tufts of the outer rows are trimmed to a first uniform height parallel to the upper surface of the brush head and the bristles of the tufts of the at least one inner row are trimmed to a second uniform height parallel to the upper surface of the brush head. Such a preferred process comprises the steps of:

a) trimming the bristles to a first uniform height parallel to the upper surface of the brush head;
b) displacing the tufts of the outer rows from the tufts of the at least one inner row to permit processing of the bristles of the tufts in the at least one inner row without affecting the bristles of the tufts of the outer rows;
c) trimming the bristles of the tufts of the at least one inner row to a second uniform height less than the first uniform height;

d) polishing the free ends of the bristles of the tufts of the at least one inner row;

e) returning the tufts of the outer rows to their original orientation;

f) polishing the free ends of the bristles of the tufts of the outer rows; and g) feathering the bristles of the tufts of the outer rows.

This preferred process may also comprise additional steps such as removing debris from the brush head, as, for example, by mechanically polishing the bristles and/or by directing compressed air and/or applying vacuum to the brush head.

Yet another preferred process of the present invention comprises the steps of a) polishing the free ends of at least some of the bristles; and b) feathering the polished bristles.

This process may comprise additional steps, such as trimming the bristles to be polished to a uniform height prior to the polishing operation of step (a).

BRIEF DESCRIPTION OF THE DRAWINGS

The invention will be more fully understood and further advantages will become apparent when reference is made to the following detailed description of the invention and the accompanying drawings in which.

DETAILED DESCRIPTION OF THE INVENTION

Figure 1:
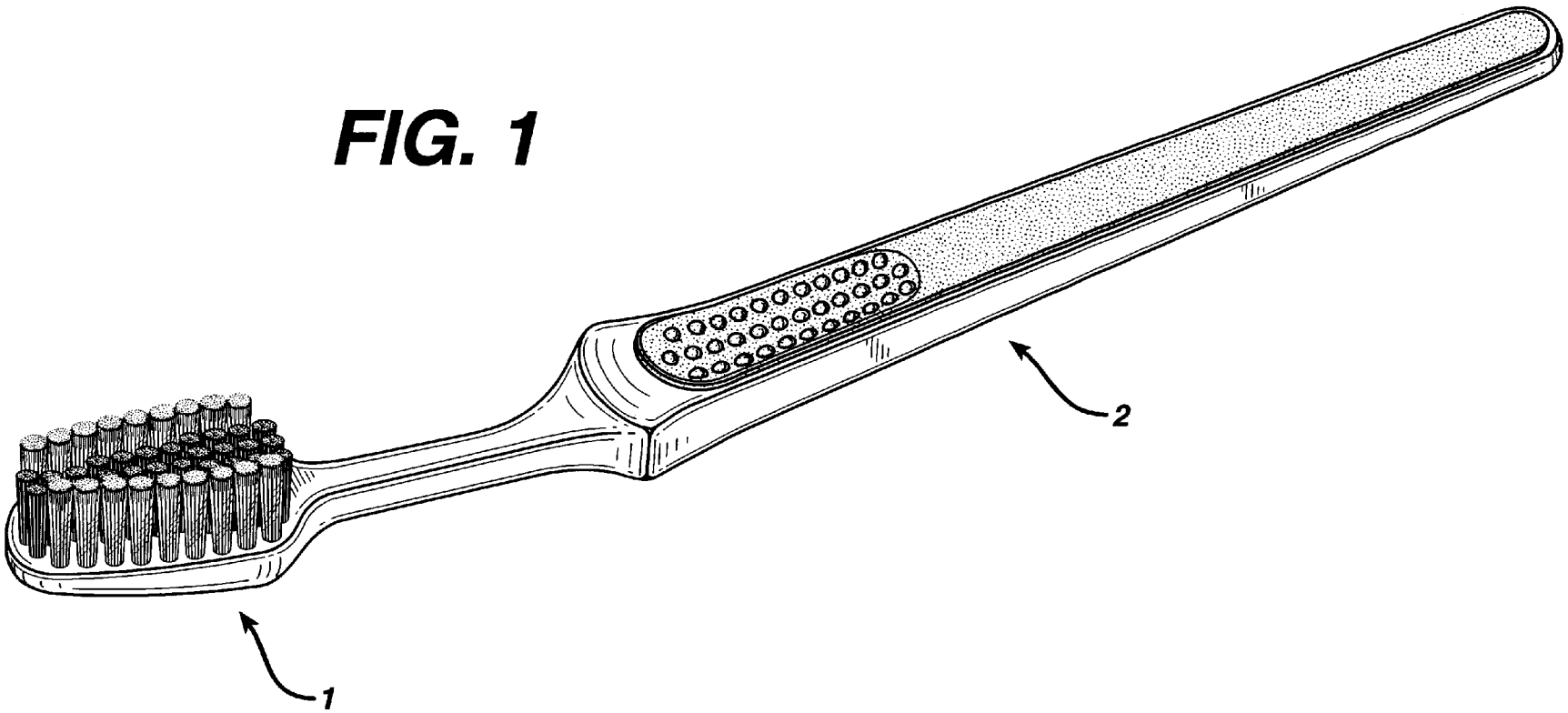
FIG. 1 is a perspective view of one embodiment of the toothbrush of the invention.
Figure 2:
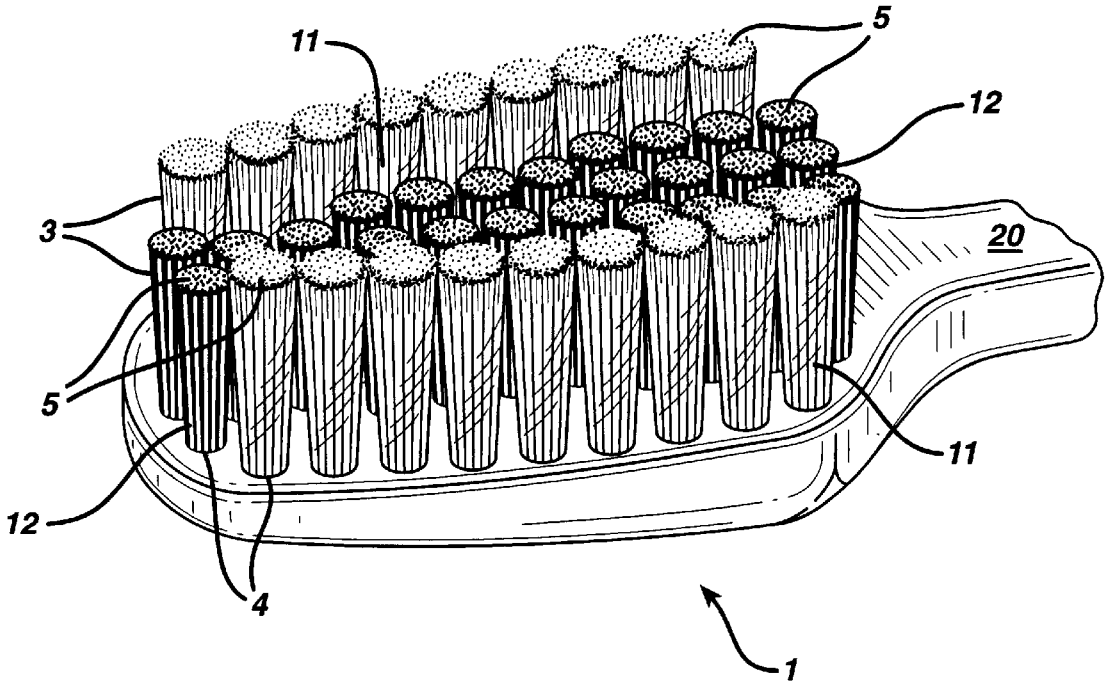
FIG. 2 is an enlarged perspective view of the brush head of the toothbrush of FIG. 1.

One aspect of the present invention relates to an improved toothbrush that effectively accesses the subgingival regions, i.e., the region between the teeth and the gumline. We have found that feathering of toothbrush bristles gives rise to improved subgingival access, although the resultant feathered toothbrush tends to irritate the gums of some users. We have discovered, quite unexpectedly, that this irritation may be substantially reduced by polishing the bristles so as to round their free ends prior to feathering.

One embodiment of a toothbrush of the present invention is depicted in FIGS. 1–4. The toothbrush of the invention comprises a brush head 1 and a handle 2. The brush head, which can me made, e.g., of polypropylene, comprises tufts of bristles 3 that have a first end 4 secured to the brush head and a second free end 5 remote from the first end 4. The bristles may be secured to the brush head by any means known in the art, e.g., by securing the bristles to the brush head with metal anchors or staples. The tufts of bristles are generally parallel to each other in the vertical dimension of the toothbrush. As used herein, the term "vertical" refers to that dimension which rises at a 90 degree angle from the upper surface 20 of the brush head 1 of the toothbrush of the invention. The tufts of bristles are arranged in rows which are aligned generally parallel to the longitudinal axis 15 of the brush head 1. The rows of bristles may be arranged in straight lines, or, depending on the tuft pattern, they may possess some degree of curvature. While they are aligned generally parallel to the longitudinal axis of the brush head, the rows may intersect with the longitudinal axis at an angle of up to about 30 degrees.

The toothbrush of the invention comprises outer rows of tufts of bristles adjacent the periphery of the brush head, and at least one inner row of tufts of bristles between the outer rows. The illustrative embodiment of the toothbrush of the invention depicted in FIG. 3 contains five rows of bristles, rows 6 and 10 being outer rows and rows 7–9 being inner rows. The outer rows and inner rows comprise outer bristles 11 and inner bristles 12, respectively.

Figure 3:
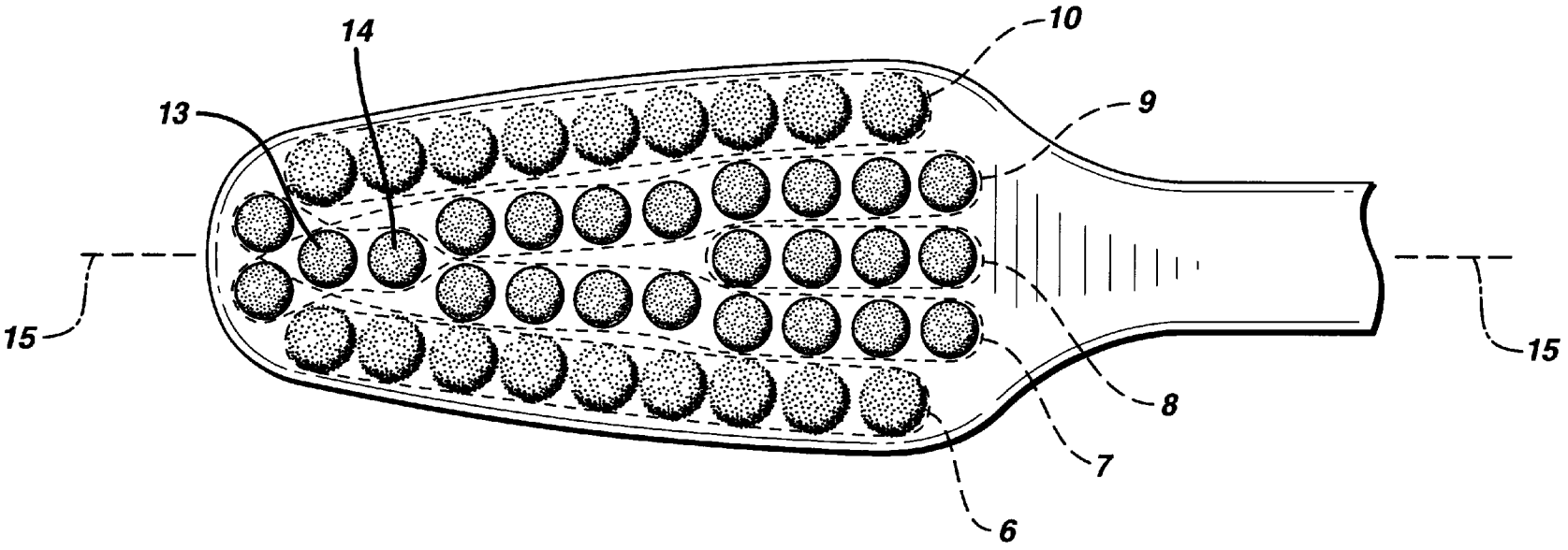
FIG. 3 is a top plan view of the brush head of FIG. 2.
Figure 4:
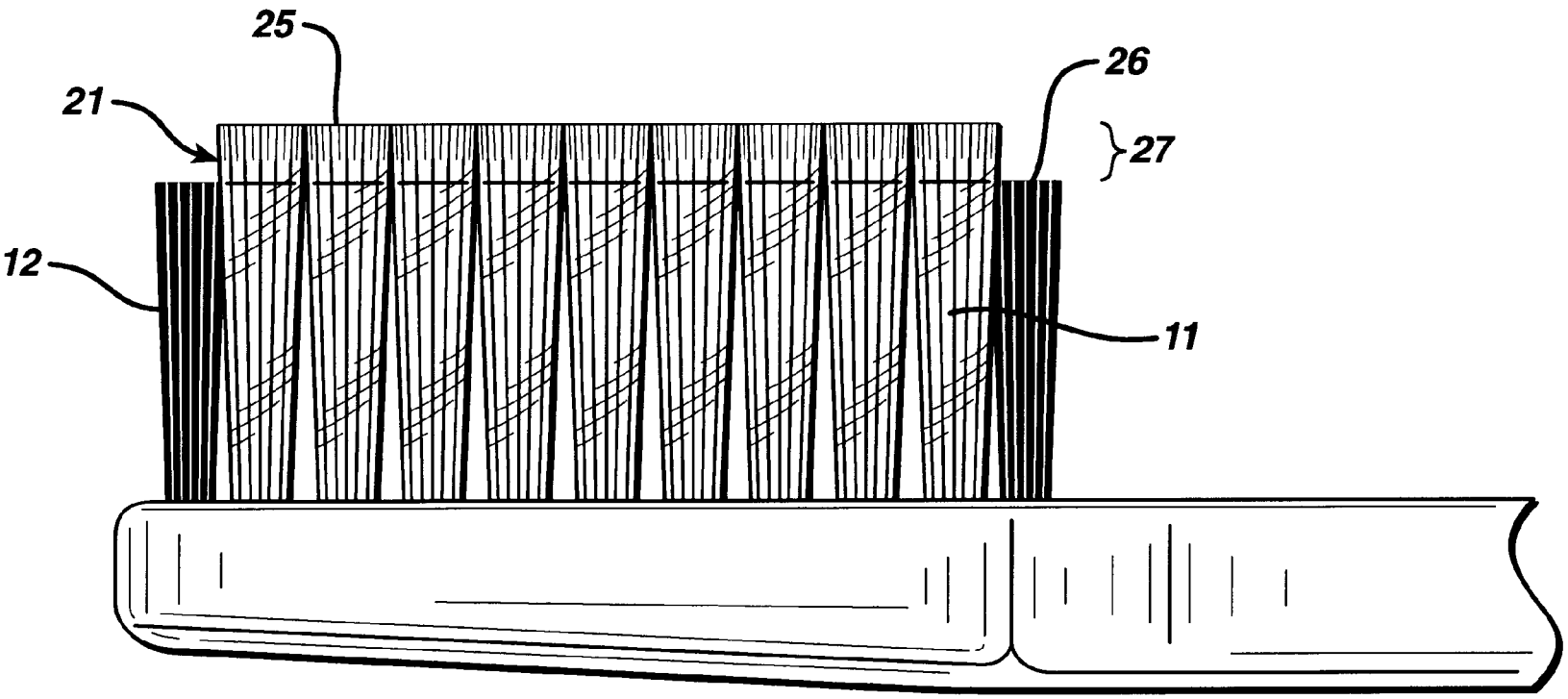
FIG. 4 is a side elevation of the brush head of FIG. 2.

As depicted in FIG. 3, the rows of bristles need not be of the same length. For example, the toothbrush of FIG. 3 has inner row 8 which contains four tufts of bristles while inner rows 7 and 9 each contain eleven tufts of bristles.

Some of the rows of bristles, for example rows 7 and 9 in FIG. 3, intersect each other. Some of the tufts of bristles may be common to more than one row of bristles. For example, tufts 13 and 14 are common to rows 7 and 9.

The bristles which comprise the toothbrushes of the present invention may be of any shape known in the art. For example, bristles are available commercially in circular or polygonal, e.g., rectangular or hexagonal cross-section. Circular cross-section bristles are preferred for the toothbrushes of the invention.

When circular cross-section bristles are used in the toothbrushes of the invention, the bristles preferably have a diameter in the range between about 6 mils to about 11 mils. More preferably, the bristles used in the toothbrushes of the invention have a diameter in the range of about 7 mils to about 8 mils.

The bristles used in the toothbrushes of the invention may be solid or hollow. Hollow bristles contain channels that have a major axis oriented parallel to the longitudinal axis of the bristle. The bristles may have from about 1 to about 6 parallel channels per bristle.

The toothbrushes of the invention may be comprised of a single type of bristle or of multiple types of bristles. For example, in the embodiment depicted in FIGS. 1–4, the bristles of the tufts of the at least one inner row are solid and the bristles of the tufts of the outer rows are hollow. It is preferred that bristles that will be feathered in the toothbrushes of the invention be hollow. As used herein, the term "feathered" as applied to bristles means that the free ends of the bristles have been split generally parallel to their longitudinal axis and subdivided to form generally longitudinally extending fine strands. Bristles having four channels per bristle, such as the tetralocular type of bristles available from DuPont Filaments of Washington, W. Va., are preferred as starting bristles for preparing the feathered bristles used in the toothbrushes of the invention.

Figure 5:
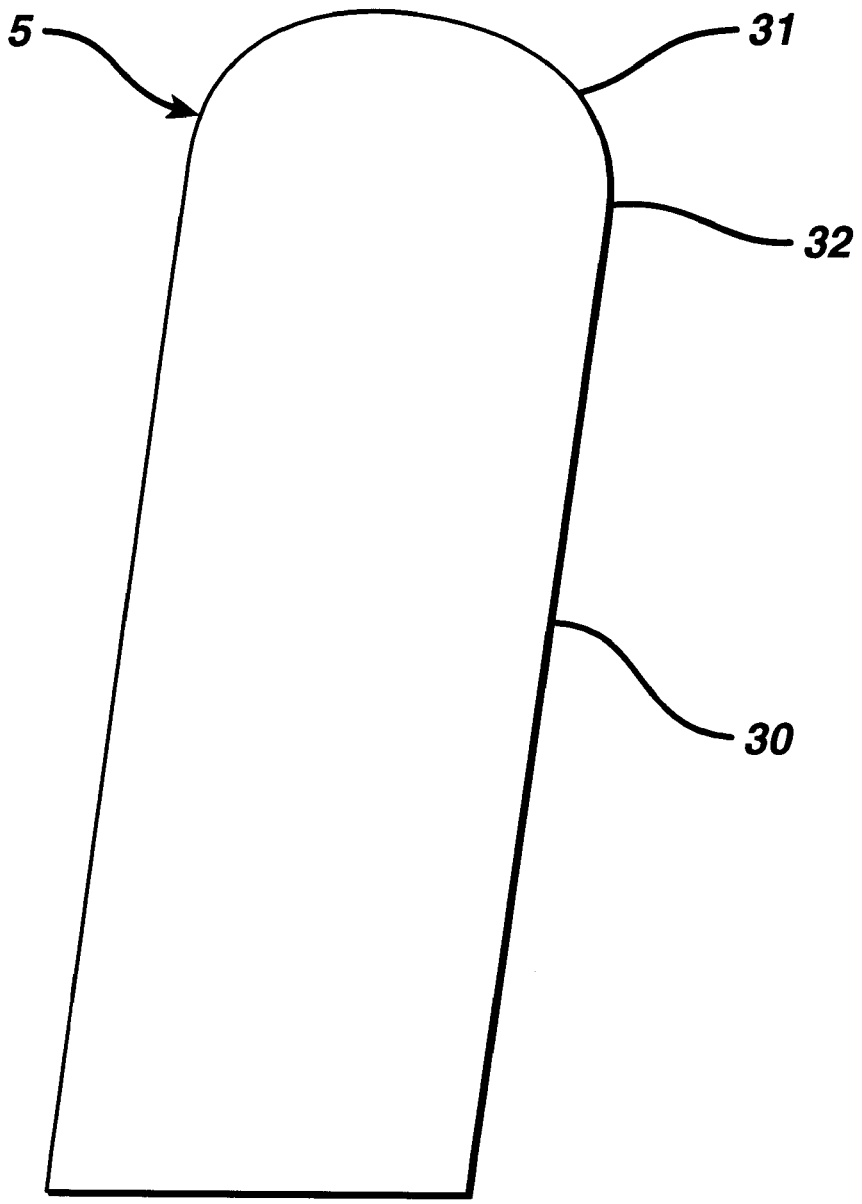
FIG. 5 is a schematic view of a trimmed but unpolished toothbrush bristle.
Figure 6:
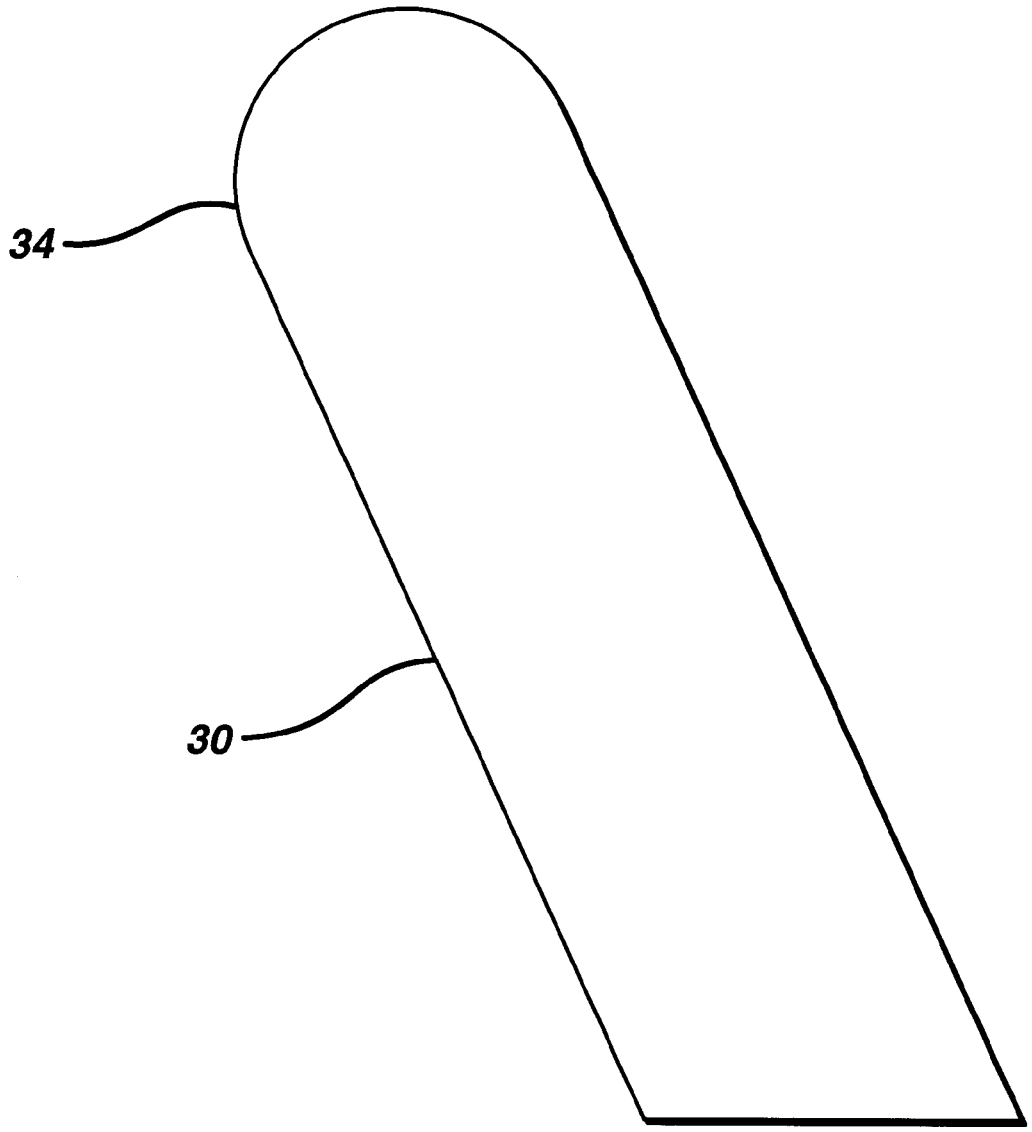
FIG. 6 is a schematic view of the bristle of FIG. 5 after polishing so as to provide a rounded free end.

The solid bristles that may be used in the toothbrushes of the invention are shown schematically in FIG. 5. As shown in FIG. 5, the trimmed but unpolished bristle 30 has a clean cut upper surface 31 and an edge 32 at the free end 5 of the bristle. Edge 32 on the bristles has been found to irritate the gums when used in brushing the teeth. Consequently, the free ends 5 of the bristles in the toothbrushes of the invention are preferably polished to produce rounded edges 34, as shown schematically in FIG. 6.

The bristles of the tufts of the outer rows of the toothbrush depicted in FIGS. 1–4 are feathered. As will be described subsequently, feathered bristles have been shown to more effectively penetrate into and clean the subgingival regions between the teeth and the gumline.

The bristles of the tufts of the at least one inner row may be the same height as the bristles of the tufts of the outer rows, or, alternatively, the bristles of the tufts of the at least one inner row may be of a different height than the bristles of the tufts of the outer rows. If different, the height of the bristles of the tufts of the at least one inner row may be less than the height of the bristles of the tufts of the outer rows, or, alternatively, the height of the bristles of the tufts of the at least one inner row may be greater than the height of the bristles of the tufts of the outer rows.

In the embodiment shown in FIGS. 1–4, the height of the bristles of the tufts of the at least one inner row is less than the height of the bristles of the tufts of the outer rows. The height of the bristles of the tufts of the at least one inner row is preferably from about 1.0 mm to about 4.0 mm less than the height of the bristles of the tufts of the outer rows. More preferably, the height of the bristles of the tufts of the at least one inner row is about 2.0 mm to about 3.0 mm less than the height of the bristles of the tufts of the outer rows. Most preferably, the height of the bristles of the tufts of the at least one inner row is about 2.2 mm to about 2.8 mm less than the height of the bristles of the tufts of the outer rows.

In the embodiment shown in FIGS. 1–4, the bristles of the tufts of the at least one inner row are preferably polished so as to be rounded at their free ends and the bristles of the tufts of the outer rows are preferably feathered. The use of two bristle heights and two bristle surface structures in the toothbrushes of the invention, i.e., bristles of the tufts of the at least one inner row that are end-rounded and shorter than the feathered bristles of the tufts of the outer rows, permits the bristles of the tufts of the at least one inner row to achieve good contact with and cleaning of the front and rear faces of the teeth during brushing while permitting the bristles of the tufts of the outer rows to simultaneously achieve good subgingival access and cleaning of the teeth at the gumline. Rounding of the bristle ends reduces irritation of the gums by the toothbrush of the invention.

In the embodiment of FIGS. 1–4, the bristles of the tufts of the outer rows are feathered and the bristles of the tufts of the at least one inner row are end-rounded but not feathered. The bristles of the tufts of the outer rows are feathered from their free end 25 to a depth indicated by numeral 21. The difference in height between the bristles of the tufts of the outer rows and the bristles of the tufts of the at least on inner row is indicated by numeral 27. In order to feather the bristles of the tufts of the outer rows while leaving the bristles of the tufts of the at least one inner row unfeathered, it is preferable that the bristles of the tufts of the outer rows are feathered to a depth that is above the free end 26 of the bristles of the tufts of the at least one inner row.

The depth of feathering 21 from the free ends 25 of the bristles of the tufts of the outer rows will depend upon the difference in height, indicated by numeral 27, between the bristles of the tufts of the at least one inner row and the bristles of the tufts of the outer rows. The bristles of the tufts of the outer rows are preferably feathered to a depth between about 0.5 mm to about 2.5 mm. More preferably, the bristles of the tufts of the outer rows are feathered to a depth between about 1.0 mm to about 2.0 mm. The depth of feathering 21 is preferably no greater than the difference in height 27 between the bristles of the tufts of the at least one inner row and the bristles of the tufts of the outer rows.

Another aspect of the present invention relates to the process of making the toothbrushes of the invention. One embodiment of the process of making the toothbrush of the invention comprising the steps of:

a) trimming the bristles of the tufts of at least the outer rows to a first desired topography;
b) displacing the tufts of the outer rows from the tufts of the at least one inner row to permit processing of the bristles of the tufts in the at least one inner row without affecting the bristles of the tufts of the outer rows;
c) trimming the bristles of the tufts of the at least one inner row to a second desired topography;
d) polishing the free ends of the bristles of the tufts of the at least one inner row;
e) returning the tufts of the outer rows to their original orientation; and
f) feathering the bristles of the tufts of at least the outer rows.

It will be recognized by those skilled in the art that the process steps described above may be carried out in an order other than that listed above. For example, trimming step (a) may be effected after returning the tufts of the outer rows to their original orientation, i.e., after step (e).

Step (a) involves trimming the bristles of the tufts of at least the outer rows to a desired topography. For example, the bristles of the tufts of the outer rows may all be trimmed to a common height as seen in FIGS. 1–4. The free ends 25 of the bristles of the tufts of the outer rows lie in a plane that is parallel to the upper surface 20 of the brush head. Alternatively, the bristles of the tufts of the outer rows may be trimmed to a variable height so as to provide an alternate configuration. For example, when viewed in side elevation, the bristles may have a sawtooth configuration. Alternatively, the bristles may vary in height linearly, or they may assume an arcuate configuration.

If it is desired to trim the bristles of the tufts of the at least one inner row to a topography that is different than that of the bristles of the tufts of the outer rows, it is desirable to displace the tufts of the outer rows from the tufts of the at least one inner row to permit processing the bristles of the tufts of the at least one inner row without affecting the bristles of the tufts of the outer rows. This displacement of the tufts of the outer rows from the tufts of the at least one inner row is effected in step (b).

In the case of non-rectangular brush heads, it is difficult to cleanly displace the tufts of the outer rows from the tufts of the at least one inner row over the entirety of the brush head using a fixed spreading means. A device that is useful for displacing the tufts of the outer rows from the tufts of the at least one inner row, especially for non-rectangular toothbrush heads, is disclosed in European Patent application number 0 639 340, the disclosure of which is incorporated herein by reference. The use of a cam driven spreading means, as disclosed in the above referenced European application, is preferred for cleanly displacing the tufts of the outer rows from the tufts of the at least one inner row in non-rectangular brush heads.

After the outer rows of bristles are displaced from the at least one inner row of bristles in step (b), the bristles of the tufts of the at least one inner row are trimmed to the second desired topography. The topography of the bristles of the tufts of the at least one inner row may be the same as or different than the topography of the bristles of the tufts of the outer rows. As with the first topography of the bristles of the tufts of the outer rows, the bristles 12 of the tufts of the at least one inner row may all be trimmed to a common height as seen in FIGS. 1–4. The free ends 26 of the bristles of the tufts of the at least one inner row lie in a plane that is parallel to the upper surface 20 of the brush head. Alternatively, the bristles of the tufts of the at least one inner row may be trimmed to a variable height so as to provide an alternate configuration. For example, when viewed in side elevation, the bristles may have a sawtooth configuration. Alternatively, the bristles may vary in height linearly, or they may assume an arcuate configuration.

Once the bristles of the tufts of the at least one inner row are trimmed according to step (c), the free ends of the bristles of the tufts of the at least one inner row are polished, for example, mechanically or by flame polishing, so as to round their free ends. The free ends of the bristles of the tufts of the at least one inner row are rounded in order to reduce possible irritation to the gums that would be induced by sharp edges on the trimmed bristles of the tufts of the at least one inner row.

The trimming and polishing operations may be accomplished using any of the tools known in the art to effect such trimming and polishing steps.

Once the bristles of the tufts of the at least one inner row are polished, the displacing means are retracted in order to allow the tufts of the outer rows to return to their original orientation in step (e).

Figure 7A:
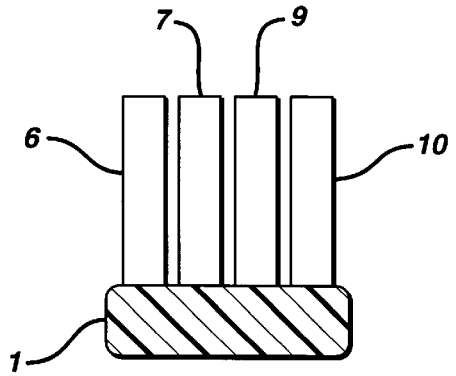
FIGS. 7A through 7D are schematic end views of the toothbrush of the invention at various stages of its manufacturing process.
Figure 7B:
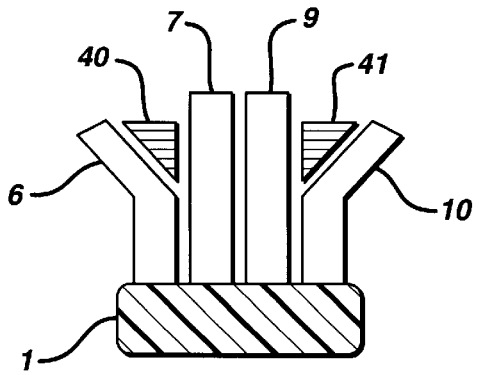
Figure 7C:
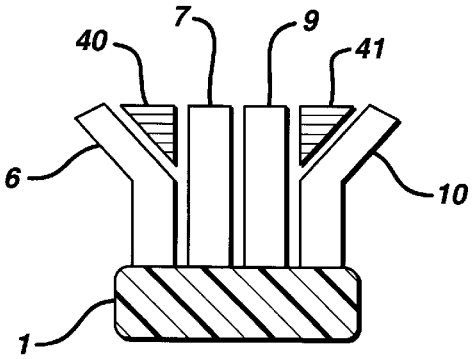
Figure 7D:
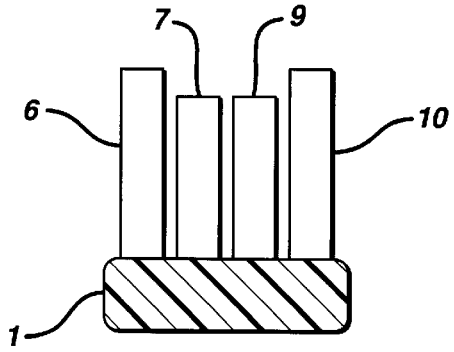

The steps involving displacing the tufts of the outer rows from the tufts of the at least one inner row (step (b)), trimming and polishing the bristles of the tufts of the at least one inner row (steps c and d), and returning the tufts of the outer rows to their original orientation (step e) may be better understood by reference to FIGS. 7A through 7D. FIGS. 7A through 7D show schematic views of the toothbrush at various stages in the process. FIG. 7A shows an end view of the toothbrush of FIGS. 1–4, in which all of the bristles are trimmed to a uniform height and in which tufts of the two outer rows of bristles 6 and 10 are parallel to the tufts of the two inner rows of bristles 7 and 9. FIG. 7B shows the toothbrush after spreader arm 40 is inserted between the tufts of outer row 6 and inner row 7 and spreader arm 41 is inserted between the tufts of outer row 10 and inner row 9. Once the tufts of the outer rows are displaced from the tufts of the inner rows, the bristles of the tufts of the inner rows may be trimmed to a second desired topography in step (c) and subsequently polished in step (d) without affecting the bristles of the tufts of the outer rows. FIG. 7C shows the toothbrush with the spreader arms still in place after the bristles of the tufts of the inner rows have been trimmed to a height shorter than the bristles of the tufts of the outer rows. FIG. 7D shows the toothbrush after the spreader arms 40 and 41 have been retracted and outer rows of bristles 6 and 10 have returned to their original orientation shown in FIG. 7A.

Once the spreading arms are retracted so as to return the tufts of the outer rows to their original orientation, the bristles of the tufts of the outer rows may be feathered. Feathering is accomplished by traversing multiple arbor-mounted knives that rotate at high speed transversely across the free ends of the bristles on the brush head. The desired depth and extent of feathering may be controlled by controlling the depth of contact of the bristles with the rotating knives and the contact time.

As indicated previously, we have found that feathering of toothbrush bristles gives rise to improved subgingival access. However, the feathered bristles may irritate the gums of some users. We have discovered, quite unexpectedly, that this irritation may be substantially reduced by polishing the bristles so as to round their free ends prior to feathering.

The toothbrush made by the above-described process may have bits of debris from the trimming and polishing steps attached thereto. Some of this debris may be entrained in the bristles or on the surface of the brush, while some of the debris may still be attached to the bristles as flashing from the trimming and polishing steps. The attached debris may be removed by further polishing the bristles. Additionally, the entrained debris may be removed bv directing pressurized air at the brush head and/or by vacuuming the brush head.

The heights to which the bristles are trimmed and the depth to which the bristles are feathered correspond to the relative dimensions of the preferred toothbrush of the invention as described above.

In a preferred process for making preferred toothbrushes of the invention, all of the bristles are initially trimmed to a first uniform height parallel to the upper surface of the brush head. The bristles of the tufts of the at least one inner row are then trimmed to a second uniform height parallel to the upper surface of the brush head. Such a preferred process comprises the steps of:

a) trimming the bristles to a first uniform height parallel to the upper surface of the brush head;

b) displacing the tufts of the outer rows from the tufts of the at least one inner row to permit processing of the bristles of the tufts in the at least one inner row without affecting the bristles of the tufts of the outer rows;

c) trimming the bristles of the tufts of the at least one inner row to a second uniform height less than the first uniform height and parallel to the upper surface of the brush head; p1 d) polishing the free ends of the bristles of the tufts of the at least one inner row;

e) returning the tufts of the outer rows of bristles to their original orientation;

f) polishing the free ends of the bristles of the tufts of the outer rows; and g) feathering the bristles of the tufts of the outer rows.

This preferred process may also comprise additional steps such as removing debris from the brush head by further polishing the bristles and/or by directing compressed air at and/or by vacuuming the brush head.

In one embodiment of this process, all of the bristles are trimmed to a uniform height in step (a), which is conducted prior to the displacing step of step (b). In another embodiment, the trimming step (a) is conducted only on the bristles of the tufts of the outer rows and is conducted after step (e).

Yet another preferred process of the present invention comprises the steps of:

a) polishing the free ends of at least some of the bristles so as to round the ends of said bristles; and b) feathering the polished bristles.

This process may comprise additional steps, such as trimming the bristles to be end-rounded to a uniform height prior to conducting the polishing step of step (a).

Several examples are set forth below to further illustrate the nature of the invention and the manner of practicing the same. However, the invention should not be considered as being limited to the details thereof.

EXAMPLE 1

Figure 8:
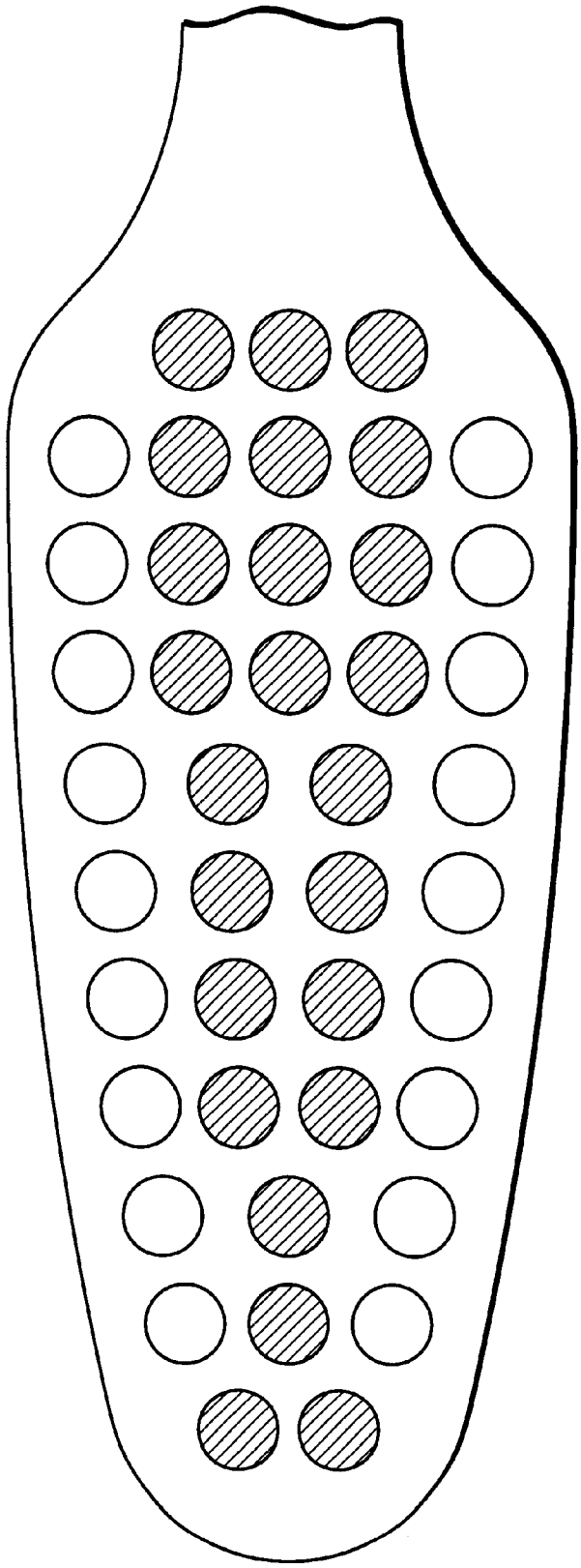
FIG. 8 is a top plan view of the brush head used in the toothbrush of the invention depicting the location of tufts of bristles comprising the outer rows and inner rows.

A toothbrush having a brush head of the design shown in FIG. 8 was bristled using conventional bristling technology well known in the art. The brush head of FIG. 8 shows the pattern of bristles in the brush head. The shaded and unshaded circles represent the tuft holes that contain the tufts of the inner rows and the tufts of the outer rows, respectively. The bristles of the tufts of the at least one inner row were solid, substantially round in cross-section, having a diameter of 7 mils, and were made of duPont Tynex 900 brand of nylon 6,12. The bristles of the tufts of the outer rows were hollow and were of the tetralocular design, i.e., they had four parallel channels running the length of the bristles. The bristles of the tufts of the outer rows also had a diameter of 7 mils and were made of duPont Tynex 900 brand of nylon 6,12.

The tufts were fastened into the pre-formed holes in the brush head with metal anchors in known fashion. Each tuft was comprised of approximately 60 bristles.

Toothbrushes were clamped into holders and were subjected to the following trimming, polishing and feathering operations:

The brush was sent to a first trimming station where all of the bristles were rough-trimmed to a height of approximately 11.9 mm using a Model Z4DIA55 mm rotary cutter available from Machines Boucherie N.V. of Izegem, Belgium. The brush was then indexed to a second trimming station for final trimming of the bristles to a uniform height of 11.9 mm. Spreader arms were then inserted between the inner and outer rows of bristles to separate and spread, i.e., to displace the tufts of the outer rows from the tufts of the inner rows. Bristles of the tufts of the at least one inner row were then rough-.trimmed at a third trimming station to a height of approximately 9.0 mm, and were then trimmed to a final height of 9.0 mm at a fourth trimming station. The third and fourth trimming stations utilized the same type of cutter blades as the first and second trimming stations. The brushes were then indexed to a first polishing station where the inner bristles were contacted with polishing wheel Model D46N20 (Boucherie) in a polishing assembly. The polishing wheel rotated around a drive shaft at a speed of about 3500 revolutions per minute (rpm) while the entire polishing assembly rotated in an eccentric orbit at a speed of about 350 rpm. The brush was then subjected to a similar polishing step at a second polishing station using the same type of polishing wheel. The first and second polishing wheels contain abrasive surfaces that polish the free ends of the bristles so as to round their free ends. The brush was then moved to a third polishing station where the bristles contacted a Model 11142000 polishing wheel (Boucherie) to remove any excess material from the trimming and end-rounding steps that remains partially attached to the bristles. The spreader arms were then retracted, allowing the tufts of the outer rows to return to their original orientation. The brush was then indexed to a feathering unit, where multiple arbor-mounted knives rotating at about 12,000 rpm were traversed across the free ends of the bristles of the tufts of the outer rows of the brush head. Those skilled in the art will recognize that the knives may be rotated at speeds greater than or less than 12,000 rpm and still provide effective feathering. The bristles of the tufts of the outer rows were feathered to a depth of 2.4 mm. The brush was then indexed to a series of cleaning stations where the brush head was subjected to compressed air and vacuum to remove residual particles from the trimming, polishing and feathering steps.

EXAMPLE 2–4

Brushes were made in accordance with the procedure described in Example 1 with the exception that following retraction of the spreader arms, the brushes were then indexed to a fourth, fifth and sixth polishing station of the same type and function as the first, second and third polishing stations, respectively for polishing of the bristles of the tufts of the outer rows prior to feathering the bristles of the tufts of the outer rows. The bristle heights and feathering depths of the various toothbrushes of the Examples are shown in Table 1. For comparison purposes, toothbrushes were also made according to Comparative Example 1 in which the bristles of the tufts of the outer rows were not feathered in order to test the effects of feathering on toothbrush performance.

TABLE 1

| | Example 1 | Example 2 | Example 3 | Example 4 | Comparative Example 1 |
|---|---|---|---|---|---|
| inner bristle height (mm) | 9.0 | 9.0 | 9.7 | 9.0 | 9.0 |
| outer bristle height (mm) | 11.9 | 11.5 | 11.5 | 11.5 | 11.5 |
| Δ (outer-inner) (mm) | 2.9 | 2.5 | 1.8 | 2.5 | 2.5 |
| Feathered | yes | yes | yes | yes | no |
| Feathering depth (mm) | 2.4 | 1.5 | 1.5 | 1.2 | 0 |
| bristles of the tufts of the outer rows polished (end-rounded) before feathering | no | yes | yes | yes | Bristles of the tufts of the outer rows polished but not feathered |

Evalation of toothbrushes for soft-tissue irritation

The brushes produced in accordance with Examples 1 through 3 were provided to test panelists who were instructed to use these brushes in their normal daily oral hygiene regimen. The number of panelists involved in testing each of the brushes and the test duration are shown in Table 2. The panelists testing the brush of Example 1 were queried about soft tissue irritation brought about by the Example 1 toothbrush after two weeks of use. Those testing the brushes of Examples 2 and 3 were queried about soft tissue irritation brought about by the Example 2 and Example 3 toothbrushes after one week and after eight weeks of use. As indicated in Table 2, 18% of panelists testing the brush of Example 1 reported soft tissue irritation after two weeks of use. In contrast, only 5% of those using the brushes of Examples 2 and 3 reported any irritation after one week of use, and only 3 to 8% of users of the brushes of Examples 2 and 3 reported any irritation after eight weeks of use.

TABLE 2

| | Toothbrush of Example 1 | Toothbrush of Example 2 | Toothbrush of Example 3 |
|---|---|---|---|
| number of panelists | 44 | 43 | 41 |
| use period | 2 weeks | 8 weeks | 8 weeks |
| number of panelists reporting soft tissue | 8 | 2 out of 43 after 1 week<br>3 out of 40 after 8 weeks | 2 out of 41 after 1 week<br>1 out of 37 after 8 weeks |

TABLE 2-continued

| | Toothbrush of Example 1 | Toothbrush of Example 2 | Toothbrush of Example 3 |
|---|---|---|---|
| irritation percentage of panelists reporting soft tissue | 18% after 2 weeks | 5% after 1 week 8% after 8 weeks | 5% after 1 week 3% after 8 weeks |
| irritation | | | |

As indicated in Table 1, the brush of Example 1 was made without end-rounding the bristles of the tufts of the outer rows prior to feathering. In contrast, the bristles of the tufts of the outer rows of the brushes made according to Examples 2 and 3 were end-rounded prior to feathering. The lower incidence of soft tissue irritation among users of the brushes of Examples 2 and 3 suggests that end-rounding the bristles prior to feathering reduces the irritation to soft-tissue in the preferred brushes of the invention.

Evaluation of Toothbrushes for Subgingival Access and Efficacy at the Gingival Margin An in vitro method was used to assess the subgingival access of the toothbrushes of the invention. Laboratory equipment was fabricated according to the method of Nygaard-Ostby, Edvardsen and Spyvold as described in *Scand J. Dent Res* 87:424–430, 1979, the disclosure of which is hereby incorporated by reference. In summary, the technique involved independent evaluations of each toothbrush in a horizontal brushing motion against tooth shapes that simulated anterior (front) and posterior (rear) teeth. The brushes were loaded with a weight of 500 g. Simulated gingivae were prepared from self-curing dental acrylic. The marginal anatomy was developed using dental textbook guidelines. The space between the acrylic gingivae and the tooth shapes was 0.2 mm. The toothbrush to be tested was aligned with the base of the gingival margin and the brushing apparatus was set to brush for 60 seconds at two strokes per second with a 15 mm stroke in a horizontal brushing motion. The maximum depth (subgingival access) of the brushing stroke was recorded on pressure sensitive paper placed under the simulated gingivae and around the tooth shapes. Following the brushing cycle, the simulated gingivae were removed from the tooth shapes and readings of the pressure sensitive paper were measured under 3×magnification by a single investigator.

Subgingival access was evaluated using the above-described technique for several of the toothbrushes of the invention described in Table 1, along with several other commercially available toothbrushes. Seven samples of each toothbrush design were evaluated four times, affording a total of 28 evaluations of each toothbrush design. The toothbrush of Example 2 was subjected to two sets of such evaluations. The data are contained in Table 3 for the subgingival access of these brushes at the anterior teeth, at the posterior teeth, and an "overall" value which is a composite of the anterior and posterior values. The mean and standard deviation of the overall values were determined by calculating the mean and standard deviation of the subgingival access values over all teeth, both anterior and posterior.

TABLE 3

| | Subgingival Access (cm) Mean (SD) | | |
|---|---|---|---|
| | Anterior Teeth | Posterior Teeth | Overall value |
| Colgate Total | 0.016 (.02) | 0.062 (.03) | 0.039 (.035) |
| Mentadent | 0.006 (.01) | 0.119 (.04) | 0.063 (.064) |
| Oral-B Advantage | 0.008 (.01) | 0.009 (.01) | 0.009 (.012) |
| Toothbrush of Example 2 | 0.038 (.02) | 0.148 (.05) | 0.093 (.069) |
| Toothbrush of Example 3 | 0.066 (.02) | 0.138 (.03) | 0.100 (.043) |
| Toothbrush of Example 4 | 0.012 (.02) | 0.041 (.09) | 0.027 (.026) |
| Toothbrush of Comparative Example 1 | 0.053 (.02) | 0.109 (.02) | 0.082 (.034) |
| | 0.007 | 0.140 | 0.076 (.004) |

The following conclusions may be drawn from the data in Table 3:

Subgingival access at the anterior teeth by the brushes of Examples 2 and 4 is superior to all of the other brushes tested. In comparing the performance of the brushes of Example 2 vs. Example 3 (height differential of bristles of the outer rows and of the inner rows of 2.5 vs. 1.8 mm, respectively), the brush with the larger differential (Example 2) has greater subgingival access. Nevertheless, feathering is also important; the brushes of Example 2 and 3 have greater subgingival access at the anterior teeth than the brush of Comparative Example 1 (2.5 mm bristle height differential, no feathering).

Bristle height differential seems to be most important for subgingival access at the posterior teeth (compare Examples 2, 3 and 4 and Comparative Example 1).

In terms of overall subgingival access, the toothbrush of Example 2 was found to be statistically significantly superior (at the 95 to 99.9% confidence level) to all of the commercial brushes as well as superior to the unfeathered brush of comparative Example 1.

Efficacy of the toothbrushes in cleaning the teeth at the gingival margin was evaluated using the same equipment as described above for the subgingival access measurements. Efficacy was determined by measuring the length, in centimeters, of the impression made on the pressure sensitive paper at the junction of the simulated gingivae. The results are reported in Table 4 below.

TABLE 4

| Toothbrush | Overall Gingival Margin Access (cm) Mean (SD) |
|---|---|
| Colgate Total | 0.047 (.33) |
| Mentadent | 0.53 (.39) |
| Oral-B Advantage | 0.13 (.24) |
| Toothbrush of Example 2 | 0.73 (.31) |
| Toothbrush of Example 4 | 0.61 (.31) |
| Toothbrush of Comparative Example 1 | 0.38 (.28) |

The toothbrush of Example 2 was found to be statistically superior (at the 99.9% confidence level) to all of the commercial brushes as well as to the brush of Comparative Example 1 with respect to gingival margin access.

In the foregoing description, it will be readily apparent that modifications may be made to the invention without departing from the concepts disclosed herein. Such modifications are to be considered as included in the following claims, unless these claims by their language expressly state otherwise.

What is claimed is:

1. A process for making a toothbrush, said toothbrush comprising a brush head and a handle, said brush head comprising a plurality of tufts, each of said tufts comprising a plurality of bristles, each of said tufts having a first end secured to the brush head and a second free end, said tufts being arranged in rows aligned generally parallel to the longitudinal axis of the brush head, said rows comprising outer rows adjacent the periphery of the brush head and at least one inner row between said outer rows, said process comprising the steps of:

a) trimming the bristles of the tufts of at least the outer rows to provide a first desired topography;

b) displacing the tufts of the outer rows from the tufts of said at least one inner row to permit processing of the bristles of the tufts in said at least one inner row without affecting the bristles of the tufts of said outer rows;

c) trimming the bristles of the tufts of the at least one inner row to a second desired topography;

d) polishing the free ends of the bristles of the tufts of said at least one inner row;

e) returning the tufts of the outer rows to their original orientation; and f) feathering the bristles of the tufts of at least said outer rows.

2. The process of claim 1 which further comprises the step of polishing the free ends of the bristles of the tufts of said outer rows prior to feathering the bristles of the tufts of said outer rows.

3. The process of claim 1 which further comprises the step of removing debris from the trimmed, polished and feathered brush head.

4. The process of claim 1 wherein step (b) is accomplished with a cam-driven spreading mechanism.

5. The process of claim 1 wherein step (a) is effected only on the outer rows of bristles and is effected after step (e).

6. The process of claim 1 wherein the bristles of the tufts in the at least one inner row are trimmed simultaneous with the bristles of the tufts of the outer rows in step (a).

7. The process of claim 1 wherein at least some of the bristles in the outer rows are hollow.

8. The process of claim 7 wherein said hollow bristles comprise channels having a major axis oriented parallel to the longitudinal axis of the bristles.

9. The process of claim 8 wherein the hollow bristles comprise from about 1 to about 6 channels per bristle.

10. The process of claim 9 wherein the hollow bristles comprise 4 channels per bristle.

11. The process of claim 1 wherein the bristles of the tufts of the at least one inner row are trimmed to a height less than the height of the bristles of the tufts of said outer rows.

12. The process of claim 11 wherein the bristles of the tufts of said at least one inner row are trimmed to a height between about 1.0 to about 4.0 mm less than the height of the bristles of the tufts of said outer rows.

13. The process of claim 11 wherein the bristles of the tufts of said at least one inner row are trimmed to a height between about 2.0 to about 3.0 mm less than the height of the bristles of the tufts of said outer rows.

14. The process of claim 11 wherein the bristles of the tufts of said at least one inner row are trimmed to a height between about 2.2 to about 2.8 mm less than the height of the bristles of the tufts of said outer rows.

15. The process of claim 11 wherein substantially all of the bristles of the tufts of the outer rows are feathered and substantially none of the bristles of the tufts of said at least one inner row are feathered.

16. The process of claim 15 wherein the bristles of the tufts of said outer rows are feathered to a depth, said depth being no deeper than the free ends of the bristles of the tufts of said at least one inner row.

17. The process of claim 16 wherein the bristles of the tufts of said outer rows are feathered to a depth of between about 0.5 to about 2.5 mm.

18. The process of claim 16 wherein the bristles of the tufts of said outer rows are feathered to a depth of about 1.0 to about 2.0 mm.

19. The process of claim 11 wherein substantially all of the bristles are feathered.

20. The process of claim 1 wherein the bristles of the tufts of said at least one inner row are trimmed to substantially the same height as the bristles of the tufts of said outer rows.

21. The process of claim 20 wherein substantially all of the bristles are feathered.

22. The process of claim 1 wherein the bristles of the tufts of said at least one inner row are trimmed to a height greater than height of the bristles of the tufts of said outer rows.

23. The process of claim 22 wherein substantially all of the bristles are feathered.

24. The process of claim 1 wherein substantially all of the bristles of the tufts of said outer rows are feathered and substantially none of the bristles of the tufts of said at least inner row are feathered.

25. The process of claim 1 wherein the bristles of the tufts of said outer rows are trimmed to a first uniform height parallel to the upper surface of the brush head.

26. The process of claim 1 wherein the bristles of the tufts of said at least one inner row are trimmed to a second uniform height parallel to the upper surface of the brush head.

27. The process of claim 1 wherein the bristles of the tufts of said outer rows are trimmed to a first uniform height parallel to the brush head and the bristles of the tufts of said at least one inner row are trimmed to a second uniform height parallel to the upper surface of the brush head, said first height being greater than said second height.

28. A process for making a toothbrush, said toothbrush comprising a brush head and a handle, said brush head comprising a plurality of tufts, each of said tufts comprising a plurality of bristles, each of said tufts having a first end secured to the brush head and a second free end, said tufts being arranged in rows aligned generally parallel to the longitudinal axis of the brush head, said rows comprising outer rows adjacent the periphery of the brush head and at least one inner row between said outer rows, said process comprising the steps of:

a) trimming the bristles to a first uniform height;

b) displacing the tufts of the outer rows from the tufts of said at least one inner row to permit processing of the bristles of the tufts in said at least one inner row without affecting the bristles of the tufts of said outer rows;

c) trimming the bristles of the tufts of the at least one inner row to a second uniform height less than the first uniform height;

d) polishing the free ends of the bristles of the tufts of the at least one inner row;

e) returning the tufts of the outer rows to their original orientation;

f) polishing the free ends of the bristles of the tufts of said outer rows; and g) feathering the bristles of the tufts of said outer rows.

29. The process of claim 28 which further comprises the step of removing debris from the trimmed, feathered and polished brush head by further polishing the bristles and by directing compressed air at and applying a vacuum to the brush head.

30. The process of claim 28 wherein displacing the tufts of the outer rows from the tufts of the at least one inner row of step (b) is accomplished with a cam-driven spreading mechanism.

31. The process of claim 28 wherein substantially all of the bristles of the tufts of the outer rows are hollow.

32. The process of claim 31 wherein said hollow bristles comprise channels having a major axis parallel to the longitudinal axis of the bristles.

33. The process of claim 32 wherein the hollow bristles comprise 4 channels per bristle.

34. The process of claim 28 wherein the bristles of the tufts of the at least one inner row are trimmed to a height between about 1.0 to about 4.0 mm less than the height of the bristles of the tufts of the outer rows.

35. The process of claim 28 wherein the bristles of the tufts of the at least one inner row are trimmed to a height between about 2.0 to about 3.0 mm less than the height of the bristles of the tufts of the outer rows.

36. The process of claim 28 wherein the bristles of the tufts of the at least one inner row are trimmed to a height between about 2.2 to about 2.8 mm less than the height of the bristles of the tufts of the outer rows.

37. The process of claim 28 wherein substantially all of the bristles of the tufts of the outer rows are feathered and substantially none of the bristles of the tufts of the at least one inner row are feathered.

38. The process of claim 28 wherein the bristles of the tufts of the outer rows are feathered to a depth, said depth being no deeper than the free ends of the bristles of the at least one inner row.

39. The process of claim 38 wherein the bristles of the tufts of the outer rows are feathered to a depth between about 0.5 to about 2.5 mm.

40. The process of claim 38 wherein the bristles of the tufts of the outer rows are feathered to a depth between about 1.0 to about 2.0 mm.

41. The process of claim 28 wherein the trimming step (a) is conducted before step (b) and is performed to trim substantially all of the bristles in the toothbrush.

42. The process of claim 28 wherein the trimming step (a) is conducted after step (e) and is performed to trim only the outer bristles.

43. Process for making a toothbrush, said toothbrush comprising a brush head and a handle, said brush head comprising a plurality of tufts, each of said tufts comprising a plurality of bristles, each of said tufts having a first end secured to the brush head and a second free end, said process comprising the steps of:

a) polishing the free ends of at least some of the bristles;

b) feathering the polished bristles.

44. The process of claim 43 wherein step (a) is preceded by a trimming step in which the bristles to be polished are first trimmed.

* * * * *